United States Patent [19]

Oftedahl

[11] Patent Number: 4,508,416

[45] Date of Patent: Apr. 2, 1985

[54] MULTIPLE THERMOCOUPLE CONNECTOR PANEL

[75] Inventor: Glen F. Oftedahl, Antioch, Ill.

[73] Assignee: Pneumo Corporation, Boston, Mass.

[21] Appl. No.: 364,995

[22] Filed: Apr. 2, 1982

[51] Int. Cl.[3] ..... H01R 13/50

[52] U.S. Cl. ..... 339/176 M; 339/92 M; 339/176 T; 339/198 G

[58] Field of Search ..... 339/75 R, 75 M, 198 G, 339/198 GA, 198 H, 191 M, 18 P, 176 T, 208, 92 M, 176 M

[56] References Cited

U.S. PATENT DOCUMENTS

| | | | |
|---|---|---|---|
| Re. 20,608 | 12/1937 | Koheher | 339/176 M X |
| 2,307,972 | 1/1943 | Strunk | 339/92 M |
| 2,823,364 | 2/1958 | Walter | 339/191 M |
| 2,904,771 | 9/1959 | Burti et al. | 339/92 M X |
| 3,042,895 | 7/1962 | Bonhomme | 339/176 M |
| 3,294,592 | 12/1966 | Fish et al. | 339/176 T |
| 3,393,399 | 7/1968 | Hollander | 339/176 M |
| 3,760,336 | 9/1973 | Cerwin | 339/92 M |

FOREIGN PATENT DOCUMENTS

| | | | |
|---|---|---|---|
| 15507 | 12/1971 | Australia | 339/198.6 |
| 1221837 | 1/1960 | France | 339/198 H |

OTHER PUBLICATIONS

Allen Bradley Co., Bulletin 1492, terminal blocks, p. 9, Jan. 1966.

*Primary Examiner*—William R. Briggs
*Attorney, Agent, or Firm*—Maky, Renner, Otto & Boisselle

[57] ABSTRACT

A multiple thermocouple connector panel including a row of standard thermocouple connectors having terminals with rear ends normally adapted to be connected to lead wires, characterized by terminal extenders connected to such rear ends which extend the effective length of the terminals to the rear of the connectors so as to provide for ease of attachment of lead wires after assembly of all the connectors in the panel. The connectors may be mounted between a faceplate and a mounting plate with the faceplate and mounting plate abutting respective proximal surfaces of the connector housings. The mounting plate is made of insulating material and is provided with terminal openings through which the terminal extenders extend and project beyond the rear of the mounting plate, each terminal being transversely located by a respective one of the openings and mutually insulated by a portion of the mounting plate.

11 Claims, 5 Drawing Figures

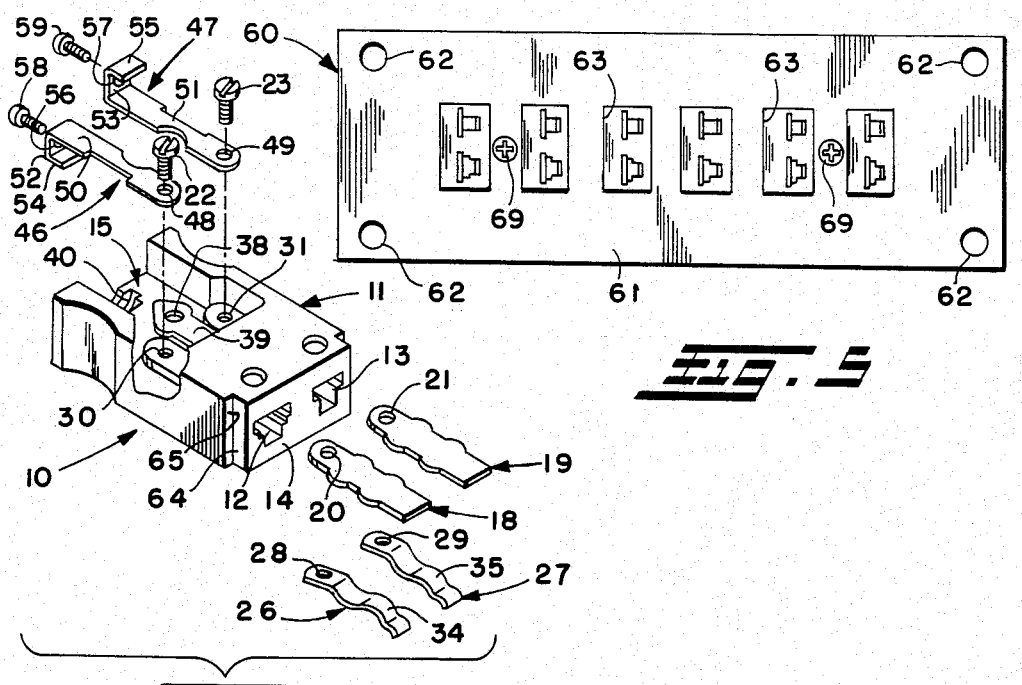
FIG. 5
FIG. 1
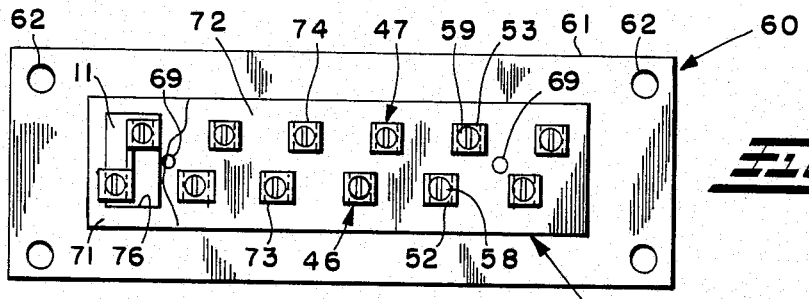
FIG. 4
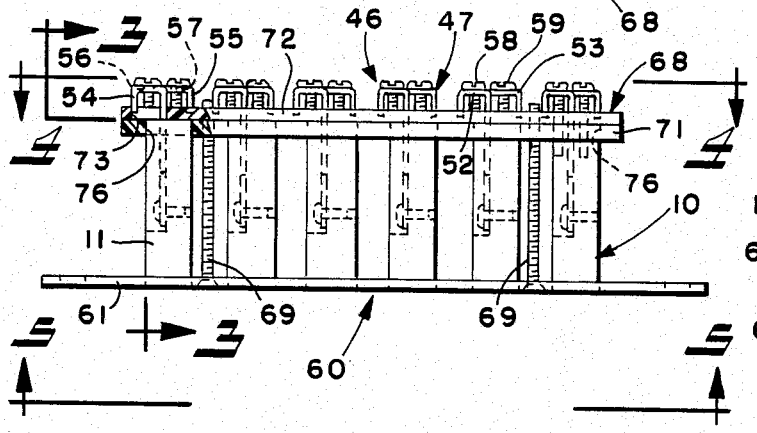
FIG. 2
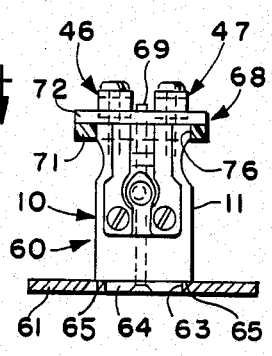
FIG. 3

MULTIPLE THERMOCOUPLE CONNECTOR PANEL

This invention relates generally to electrical connectors and more particularly to multiple connector panels which are particularly suited for use with thermocouple leads and circuits.

BACKGROUND OF THE INVENTION

Temperature measuring and/or control apparatus often utilize a plurality of thermocouples which are located at points remote from the apparatus. In order to facilitate the connection of thermocouple leads to respective thermocouple circuits in the apparatus and/or the replacement of the thermocouples, it is customary to provide mating plug and jack connectors with each pair of thermocouple lead wires. Typically, the jack or female connectors are mounted in panels which in turn are mounted on the apparatus, as on an instrument panel, to serve as terminal connections for the thermocouple circuits, the thermocouple lead wires being connected to jack connectors by corresponding plug or male connectors.

Various approaches to assembling the jack or plug connectors in panels have been taken, and some advantageously have utilized standard connectors which are useful either in the panels or as individual connectors. One approach, for example, utilizes respective metal adaptor clips to hold standard connectors to a metal faceplate, each adaptor clip being secured to the faceplate by two screws and to the side of the connector by another screw. Another approach utilizes brackets which extend around the rear of respective standard connectors and are secured to the faceplate by a number of screws. Such assemblies, however, are relatively difficult to assemble and, of more significance, suffer from a common drawback in that the wire connections to the back sides of the connectors ordinarily must be made before the connectors can be attached to the faceplates in generally parallel, laterally disposed relationship.

Still other approaches are known which allow the wire connections to be made after the connectors are mounted to the faceplate, but at the expense of having to use specially formed parts. The connector panel shown in U.S. Pat. No. 2,823,364, for example, requires the use of a special plastic part for mounting the contact members thereof to the faceplate and bringing them to the rear of the assembly for greater ease in attaching the wires interconnecting same to the apparatus instrumentation. In U.S. Pat. No. 3,179,915 another connector panel is shown which requires specially shaped contact members that are secured in paired relation to the rear of a faceplate by means of mating housing sections and a U-shaped mounting plate. Still another connector panel is shown in U.S. Pat. No. 3,046,516, such utilizing specially shaped separable connector units and T-shape guideways for mounting the units to a panel board.

SUMMARY OF THE INVENTION

With the foregoing in mind, the present invention provides a multiple connector panel which obtains advantages of known panels while eliminating the aforementioned drawbacks associated therewith. That is, the present invention provides a connector panel which may utilize standard connectors while allowing for wire attachment after all connectors are mounted to a faceplate.

Briefly, a multiple connector panel according to the invention may utilize standard connectors of the type including a housing of insulating material which has at least one and usually two sockets extending longitudinally from the front end of the housing to a lead wire receiving aperture opening to the rear end of the housing. Each socket has received therein a terminal or contact member which is adapted at its front end for electrical contact with a corresponding terminal member of a mating connector and at its rear end within the aperture for connection to a lead wire. In accordance with the invention, a terminal extender received in the aperture is connected to the rear end of each terminal and extends to the rear of the housing thereby to extend the effective length of the terminal to the rear of the connector so as to provide for attachment of a lead wire even after all connectors have been mounted to a faceplate in generally parallel, laterally disposed relationship.

Further in accordance with the invention, connectors may be mounted to the faceplate by a mounting plate secured to the faceplate with the faceplate and mounting plate abutting respective proximal surfaces of the connector housings. The mounting plate is made of insulating material and is provided with terminal openings through which rearwardly extended terminals or terminal extenders extend and project beyond the rear of the mounting plate, each extended terminal or terminal extender being transversely located by a respective one of the openings and mutually insulated by a portion of the mounting plate. The mounting plate further may be provided at its front face with recesses for accommodating the rear ends of respective connector housings thereby to retain the connectors in spaced predetermined relationship, whereas the front ends of the housings are retained in such spaced predetermined relationship by collars received in openings in the faceplate. Preferably, the mounting plate consists of two assembled pieces, the terminal openings being formed in the outermost piece while the recesses are formed by openings in the innermost piece. With the completed assembly, lead wires may be easily attached to the connectors as by screws threaded in longitudinally extending holes in the rear ends of the extended terminals or terminal extenders.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

BRIEF DESCRIPTION OF THE DRAWING

In the annexed drawing:

FIG. 1 is an exploded perspective view of a standard jack connector provided with terminal extenders in accordance with the invention;

FIG. 2 is a top plan view of a multiple connector panel according to the invention which utilizes a plurality of jack connectors of the type shown in FIG. 1 and which is partly broken away and in section for illustration;

FIG. 3 is a fragmentary sectional view of the panel of FIG. 2 taken on the line 3—3 thereof;

FIG. 4 is a rear elevational view of the panel of FIG. 2 as seen from the line 4—4 thereof which has been partly broken away for illustration; and FIG. 5 is a front elevational view of the panel of FIG. 2 as seen from the line 5—5 thereof.

DETAILED DESCRIPTION

Referring now in detail to the drawing and initially to FIG. 1, a standard jack connector which may be utilized in accordance with the invention is designated generally be reference numeral 10, and includes a housing 11 which may be molded of a suitable insulating material such as plastic. The housing 11 has formed therein a pair of generally T-shaped sockets 12 and 13 which are laterally spaced apart and extend from the front face 14 of the housing to a lead wire receiving aperture 15. The aperture 15 opens to one side of the housing as well as to the rear end of the housing as shown.

The housing 11 may be molded about a pair of terminals or contact members 18 and 19 with such terminals thusly fixed within the cross portions of the T-shaped sockets 12 and 13, respectively. The illustrated terminals 18 and 19 are flat and have rear ends which extend longitudinally into the aperture 15 and are provided with threaded holes 20 and 21 which receive terminal screws 22 and 23.

The T-shaped sockets 12 and 13 also accommodate leaf springs 26 and 27 which may be fitted in the stem portions of such sockets in opposition to the terminals 18 and 19, respectively. When thus assembled, the rear ends of the leaf springs 26 and 27 extend longitudinally into the aperture 15 and are held in place by the shanks of the terminal screws 22 and 23 which extend through respective holes 28 and 29 in such rear ends. As the shanks of the screws 22 and 23 may project beyond the leaf springs upon tightening, the housing 11 has recesses or holes 30 or 31 which accommodate the projecting ends of the terminal screws 22 and 23, respectively.

The front ends of the leaf springs 26 and 27 are bent to form spring detents 34 and 35 which cooperate with the respective terminals 18 and 19 to bind corresponding prongs of a plug connector (not shown) when inserted into the sockets 12 and 13 between the leaf springs and terminals so as to ensure good electrical contact therebetween and to latch the plug and jack connectors together. Preferably, the prongs of the plug connector are of different widths corresponding to different width portions of the sockets which accommodate the prongs to ensure proper mating of the plug and jack connectors.

The jack connector 10 as thus far described may be used as an individual connector with stripped ends of lead wires being attached to the terminals 18 and 19 by the terminal screws 22 and 23, respectively. When thusly used, a cover (not shown) of insulating material may be employed to close the aperture 15. The cover is fitted in the open side of the aperture and attached to the housing as by a screw (not shown) secured in a bore 38 in the housing 11. Preferably, such bore is located in the generally rounded portion of a raised ridge 39 projecting into the aperture 15, such ridge preferably cooperating with a corresponding ridge of the cover to partition the aperture in the area accommodating the stripped or bare ends of the lead wires. For passage of the lead wires out of the thusly enclosed aperture, the housing at its rear end may be provided with a slot 40 in the form shown and the cover with a similar and cooperating slot, such slots together preferably accommodating a stress relief grommet through which the lead wires pass.

In addition, the jack connector 10 may be assembled along with other connectors in a panel which in turn may be assembled in a temperature and/or control apparatus to serve as terminal connections for thermocouple circuits or the like. Preferably, the connectors are mounted to a faceplate in close laterally spaced arrangement to provide a bank or row of terminal connectors to which thermocouple leads may be connected by mating connectors. However, in previous known assemblies of this type, the connectors normally preclude easy access to the terminals of adjacent connectors for wire attachment, whereby in the usual case the wire connections to the connectors have had to be made before all the connectors are mounted in the assembly.

In accordance with the present invention, lead wires may be easily electrically connected to the connector terminals 18 and 19 even after all of the connectors 10 have been pre-mounted in a panel by utilizing terminal extenders seen at 46 and 47 in FIG. 1. The terminal extenders 46 and 47 extend the effective length of the respective terminals 18 and 19 to the rear of each connector housing 11 so as to provide for attachment of wires after all connectors are pre-mounted in the panel in generally parallel, laterally disposed relationship. The terminal extenders may be made of any suitable conducting material for most applications; however, in thermocouple applications, each extender preferably is made of the same thermocouple alloy as the terminal to which it is connected to avoid errors otherwise produced by using unmatched materials.

As shown, the terminal extenders 46 and 47 may be received in the aperture 15 of the housing 11 and securely connected to the rear ends of the terminals 18 and 19 by the terminal screws 22 and 23, respectively. For this purpose, the front ends of the terminal extenders are provided with holes 48 and 49 through which the terminal screws pass for effecting such secured connection. From the terminals 18 and 19, the respective main portions 50 and 51 of the terminal extenders 46 and 47 extend longitudinally through the aperture 15 beyond the rear of the housing 11 whereat the terminal extenders are bent transversely to form web portions 52 and 53 and then in a forward direction to form side flanges 54 and 55, respectively. The side flanges 54 and 55 are thus transversely spaced from and generally parallel to the coextensive part of the main portions 50 and 51, respectively. In addition, the web portions 52 and 53 may be provided with threaded holes 56, 57 which receive terminal screws 58 and 59 for effecting attachment of lead wires to the extenders.

The particular configuration of the terminal extenders may vary with the specific type of connector with which they are utilized. However, the terminal extenders are desirably of like configuration and reversely oriented as shown for insertion into the housing and connection to the terminals. Moreover, the terminal extenders are preferably stamped from flat stock and subsequently bent as indicated. As the terminal extenders are of like configuration, only one set of stamping dies is needed to form both terminal extenders. Edge recesses in the main portions 50 and 51 of the terminal extenders accommodate and cooperate with the side walls of the housing aperture 15 and the housing ridge 39 to locate and restrict transverse pivotal movement of the terminal extenders about the terminal screws.

Reference now being had to FIGS. 2–5, a preferred form of multiple connector panel in accordance with this invention is designated generally by reference numeral 60, such panel utilizing a plurality of connectors 10 provided with terminal extenders 46 and 47 of the type previously described. However, it will be appreciated that other types of connectors employing terminal extenders or otherwise having extended terminals or contact members extending to the rear of the connector housings may be utilized while still obtaining the benefits and advantages afforded by the novel mounting arrangement provided by the present invention.

As illustrated, the connector panel 60 includes a front or faceplate 61 which may be of generally rectangular shape, with fastener holes 62 in the four corners thereof for use in subsequent mounting of the assembly on a temperature measuring and/or control apparatus, as on the instrument panel thereof. In addition, the faceplate is provided with a plurality of laterally spaced openings 63 which each receive a correspondingly shaped, projecting collar 64 on the front end of the housing 11 of the respective jack connector, such collar cooperating with the opening to retain the front end of the connector in desired predetermined spaced relationship with the other connectors. Adjacent the collar of each connector housing is a shoulder or shoulders 65 which define proximal surfaces abutting the rear face of the faceplate adjacent the respective opening therein.

The jack connectors 10 are held in such engagement with the faceplate 61 by a rearwardly spaced mounting plate 68 which may be secured to the faceplate by fasteners 69. As more fully described hereafter, the mounting plate abuts proximal surfaces on the rear end of the connector housings whereby the connectors are securely held or clamped between the faceplate and mounting plate.

The mounting plate 68 preferably is made of an insulating material such as plastic and includes inner and outer pieces 71 and 72 which desirably are secured together such as by an adhesive. The outer or rearwardmost piece 72 is provided with a plurality of openings 73 and 74 designed to closely accommodate the rear ends of the terminal extenders 46 and 47, respectively, such openings being laterally and longitudinally offset for receipt of the terminal extenders of each connector as seen in FIG. 4. Preferably, the rear ends of the extenders extend through the openings 73, 74 a short distance beyond the outer piece 72 to allow for easy connection of lead wires at the transversely extending web portions 52 and 53 thereof by the terminal screws 58 and 59 while still providing engagement of the side flanges 54 and 55 on the rear ends of the extenders with the side walls of the openings 73 and 74. As shown, the openings 73, 74 are so sized to closely accommodate the coextensive side flanges 54 and 55 and main portions 50 and 51 of the extenders, thus serving to transversely retain and locate the rear ends of the terminal extenders on the mounting plate. In addition, the rear ends of the terminal extenders are mutually insulated by portions of the outer piece 72 located between the openings 73, 74, which same portions abut proximal surfaces on the rear end of the connector housings 11.

Referring now to the inner or forwardmost piece 71 of the mounting plate 68, such can be seen to include a plurality of openings 76 which are aligned with corresponding openings 63 in the faceplate 61. Each opening 76 in the inner piece 71 corresponds in shape to the rear end of the respective connector housing accommodated therein and thus serves to retain the rear end of the connector in the desired predetermined spaced relationship with the other connectors.

Although the mounting plate 68 preferably is formed of two pieces as indicated, the mounting plate may be made in other ways such as by a one piece molding. If a one piece molding is employed, the function of the openings 76 in the inner piece 71 would be served by recesses in the inner face of the molding which extend only partially into the molding whereas the openings 73 and 74 in the outer piece 72 would be served by corresponding openings extending from the respective recesses to the rear face of the molding. However, the two piece construction is preferred in that it lends itself to forming each piece by a simple stamping operation and then simply securing the pieces together such as by a suitable adhesive.

It now can be appreciated that the foregoing connector panel 60 provides for easy attachment of lead wires to the connectors thereof after all of the connectors have been pre-assembled in the panel. Moreover, the connector panel is of simple construction, economical to manufacture, and lends itself to convenient mounting of the connectors to the faceplate thereof.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A multiple connector panel assembly comprising a faceplate, a plurality of connectors each of the type including a housing of insulating material having two longitudinally extending sockets, and two terminals respectively received in said sockets, each terminal having its front end adapted for electrical contact with a corresponding terminal of a mating connector and its rear end extending short of the rear of said housing, mounting means for mounting said connectors to the rear of said faceplate in generally parallel, laterally disposed relationship, and a terminal extender for each terminal, said terminal extender being connected at its front end to the rear end of the respective terminal and extending beyond the rear of said housing to provide for connection of a lead wire thereto, said mounting means including a mounting plate spaced from said faceplate, and means for securing said mounting plate to said faceplate with said connector housings held therebetween and said terminal extenders extending beyond the rear of said mounting plate, said mounting plate having a plurality of openings, and each terminal extender of said connectors extending through a respective one of said openings beyond the rear of said mounting plate, each terminal extender having a rear end closely accommodated in and transversely located by the respective one of said openings in said mounting plate, said mounting plate being made of insulating material and having portions mutually insulating the rear ends of adjacent terminal extenders, each terminal extender having a flat main portion bent transversely at its rear end to form a web portion and then forwardly to form a side flange, said side flange and the coextensive part of said main portion engaging opposite sides of the respective one of said openings to transversely locate the rear end of the terminal extender.

2. An assembly as set forth in claim 1, wherein said web portion has a hole adapted for secured receipt of a lead wire terminal fastener.

3. An assembly as set forth in claim 1, wherein the terminal extenders for each connector are of like configuration but reversely oriented so that the web portions thereof extend in opposite directions from respective main portions.

4. An assembly as set forth in claim 1, wherein said faceplate has a plurality of laterally spaced openings, and each said connector housing has a longitudinally extending collar at its front end extending into a respective one of said openings, each collar and respective one of said openings having corresponding transverse configurations.

5. An assembly as set forth in claim 4, wherein each connector housing has a transversely extending shoulder adjacent the collar thereof abutting the rear face of said faceplate.

6. An assembly as set forth in claim 1, wherein each socket extends from the front end of said housing to a lead wire receiving aperture opening to the rear end of said housing, the rear end of each terminal extends into said aperature, and each terminal extender is received in said aperture and extends therethrough and outwardly beyond the rear of said housing.

7. An assembly as set forth in claim 1, wherein the rear end of each terminal has a threaded hole for receipt of a lead wire terminal fastener, and each terminal extender is secured to the respective terminal by the respective terminal fastener.

8. A multiple connector panel assembly comprising a front panel including a plurality of openings therein, a plurality of connectors each including a housing of insulating material and at least one extended contact extending longitudinally through and beyond the rear of said housing, said housing having at its front end a collar extending into a respective one of said openings, a mounting plate of insulating material spaced to the rear of said front panel, said mounting plate including a plurality of openings, and each extended contact extending through and being transversely located by a respective one of said openings in said mounting plate and insulated from adjacent extended contacts by a portion of said mounting plate, and means for securing said mounting plate to said front panel with said mounting plate and front panel abutting respective proximal surfaces of the housing of each connector, said mounting plate having a plurality of laterally spaced recesses accommodating the rear ends of respective connector housings, each recess and rear end of the respective housing having corresponding transverse configurations, said openings in said mounting plate extending into said recesses and being smaller than said recesses, whereby the portion of said recesses surrounding said openings in said mounting plate abut the respective proximal surface of the housing of each connector.

9. An assembly as set forth in claim 8, wherein said mounting plate includes an inner and outer piece, said recesses being formed in said inner piece and said plurality of openings in said mounting plate being formed in said outer piece.

10. A multiple connector panel assembly comprising a front panel including a plurality of openings therein, a plurality of connectors each including a housing of insulating material and at least one extended contact extending longitudinally through and beyond the rear of said housing, said housing having at its front end a collar extending into a respective one of said openings, a mounting plate of insulating material spaced to the rear of said front panel, said mounting plate including a plurality of openings, and each extended contact extending through and being transversely located by a respective one of said openings in said mounting plate and insulated from adjacent extended contacts by a portion of said mounting plate, and means for securing said mounting plate to said front panel with said mounting plate and front panel abutting respective proximal surfaces of the housing of each connector, each contact having a flat portion bent transversely at its rear end to form a web portion and then forwardly to form a side flange, said side flange and the coextensive part of said main portion engaging opposite sides of the respective one of said openings in said mounting plate to transversely locate the rear end of the contact.

11. A multiple connector panel assembly comprising a faceplate, a plurality of connectors each of the type including a housing of insulating material having two longitudinally extending sockets, and two terminals respectively received in said sockets, each terminal having its front end adapted for electrical contact with a corresponding terminal of a mating connector and its rear end extending short of the rear of said housing, mounting means for mounting said connectors to the rear of said faceplate in generally parallel, laterally disposed relationship, and a terminal extender for each terminal, said terminal extender being connected at its front end to the rear end of the respective terminal and extending beyond the rear of said housing to provide for connection of a lead wire thereto, said mounting means including a mounting plate spaced from said faceplate, and means for securing said mounting plate to said faceplate with said connector housings held therebetween and said terminal extenders extending beyond the rear of said mounting plate, said faceplate having a plurality of laterally spaced openings, and each said connector housing having a longitudinally extending collar at its front end extending into a respective one of said openings, each collar and respective one of said openings having corresponding transverse configurations, said mounting plate having portions between said openings abutting the rear end of each connector housing, and said means for securing including fastener means for holding said plates against movement apart and away from each connector housing, said mounting plate having a plurality of laterally spaced recesses accommodating the rear ends of respective connector housings, each recess and rear end of the respective connector housing having corresponding transverse configurations, said mounting plate including an inner and outer piece, said recesses being formed in said inner piece, and said plurality of openings being formed in said outer piece.

* * * * *